United States Patent [19]

Smith, Jr. et al.

[11] 4,215,658

[45] Aug. 5, 1980

[54] ELECTRIC WATER PUMP

[75] Inventors: Richard J. Smith, Jr., Middleburg Heights; Ralph R. Bellino, Cleveland, both of Ohio

[73] Assignee: W. R. Grace & Co., New York, N.Y.

[21] Appl. No.: 805,209

[22] Filed: Jun. 9, 1977

[51] Int. Cl.[2] ..... F01P 5/10; F01P 5/12

[52] U.S. Cl. ..... 123/41.44; 123/41.46; 123/41.49; 123/195 A; 123/198 C; 123/198 R

[58] Field of Search ..... 123/195 R, 195 A, 198 R, 123/198 C, 41.46, 41.49, 41.44

[56] References Cited

U.S. PATENT DOCUMENTS

| | | | |
|---|---|---|---|
| 1,662,723 | 3/1928 | Snow | 123/41.46 |
| 2,019,476 | 11/1935 | Brownlee | 123/41.46 |
| 3,603,296 | 9/1971 | Mitchell | 123/195 A |
| 3,730,147 | 5/1973 | Buchwald | 123/195 A |
| 3,853,098 | 12/1974 | Ishikawa et al. | 123/41.49 |
| 3,894,521 | 7/1975 | Sakasegawa et al. | 123/41.49 |
| 3,999,598 | 12/1976 | Fehr et al. | 123/41.44 |
| 4,062,329 | 12/1977 | Rio | 123/41.49 |

FOREIGN PATENT DOCUMENTS

| | | | |
|---|---|---|---|
| 1039779 | 10/1953 | France | 123/195 A |

OTHER PUBLICATIONS

Mr. Gasket Co. The Performance People., 1977 ½ Supplement Catalog, Catalog Number 72207G, Jul. 9–10, 1977, p. 6.

*Primary Examiner*—Charles J. Myhre
*Assistant Examiner*—Jeffrey L. Yates
*Attorney, Agent, or Firm*—William Kovensky; Edward J. Cabic

[57] ABSTRACT

A kit for converting an automobile engine from a conventional water pump driven by mechanical engine power to electrical drive which is separately controllable independently of engine operation. The kit includes a conventional air conditioning blower motor, and a bracket which permits motion of the electric motor on the bracket, whereby the motor, belts, pulleys, etc. can be changed without having to remove the bracket from the water pump on the engine.

5 Claims, 4 Drawing Figures

ELECTRIC WATER PUMP

This invention relates to automotive water pumps and more specifically relates to an electric drive for such pumps particularly suitable for use in racing cars.

In conventional automobiles, the water pump is driven by a belt which takes mechanical power from the engine. Thus, the water pump consumes power which could otherwise be used to drive the automobile. The amount of this power consumption is not critical in ordinary usage. However, in racing cars, every small amount of power which is not delivered to the wheels could make the difference between winning and losing a race. The racer is interested in relieving the engine from as many of its tasks as possible so as to deliver the absolute maximum amount of power to the driving wheels.

The present invention fulfills this need by providing an electric drive which can be turned off when the car is making a racing run and then turned on when the car is not actually engaged in racing, or vice versa.

The invention resides in a combination of features to provide such an electric water pump having advantages and versatility heretofore unknown. The invention kit includes a standard air conditioner blower motor. This motor is heavy duty, and operates at high speed so as to drive the fan and the water pump sufficiently fast to rapidly cool down the car's engine after a racing run. The kit includes a bracket which utilizes the electric motor assembly screws to permit a swinging motion of the motor on the bracket to control belt tension while maintaining the motor shaft and the water pump shaft in a generally parallel relationship. The invention bracket will be installed on the engine using the standard bolt holes in the water pump housing used to mount the water pump to the engine. This conversion is accomplished by simply providing longer bolts of the same thread and diameter as the conventional mounting bolts. Prior electric water pumps, in order to change belt tension or mount or dismount the system from the car, required changing the connection between the bracket and the engine. In the present invention, the specially formed motor bracket permits adjustment of the electric motor while it is in place and simple assembly and disassembly of the invention electric water pump to and from the engine.

Another feature of the invention bracket is that it permits itself to be mounted in one of two positions on the water pump. On certain popular racing engines, particularly the large and small block Chevrolet engines, the water pump is held in place by four bolts, two on either side of the water pump center line. The invention is so configured as to be mounted on either pair of bolts with the electric motor for the pump extending either upwardly or downwardly, depending upon the particular environment and engine to which the invention is mounted. In this manner, the user is given great versatility in attaching the invention kit to his engine. Using plates etc., the motor can be mounted elsewhere on the engine.

Another advantage resides in the use of a positive drive between the pinion on the electric motor and a special pulley mounted to the engine fan. This is accomplished by the use of a special spacer sleeve which fits between the relatively small shaft of the electric motor used in the invention, and permits the mounting of a standard larger inside diameter positive drive pinion to such motor. That is, the spacer sleeve permits mounting of a conventional cog belt pinion intended for a relatively larger shaft, to the relatively small shaft of the conventional electric motor used in the invention. Other positive drives, as well as a conventional V-belt, could also be used. At the other end, the conventional fan pulley is replaced by a relatively light weight fiberglass filled or otherwise reinforced molded plastic large diameter pulley which is mounted to the fan of the automobile in place of the conventional fan pulley. This invention pulley has a cog drive, to mate with the drive belt and the drive pinion on the electric motor, on its outside. Its inner cylindrical face is provided with a plurality of holes, whereby the same pulley can be used in various different installations and with various different fans.

Thus there is provided an automotive electric drive kit which is extremely simple to use, highly reliable, utilizing standard and proven components, including simple means to adapt these components which were drawn from different arts, to each other, which is light weight, and yet which is highly reliable and efficient in use.

The above and other advantages of the invention will be pointed out or will become evident in the following detailed description and claims, and in the accompanying drawing also forming a part of this disclosure, in which:

Figure 1:
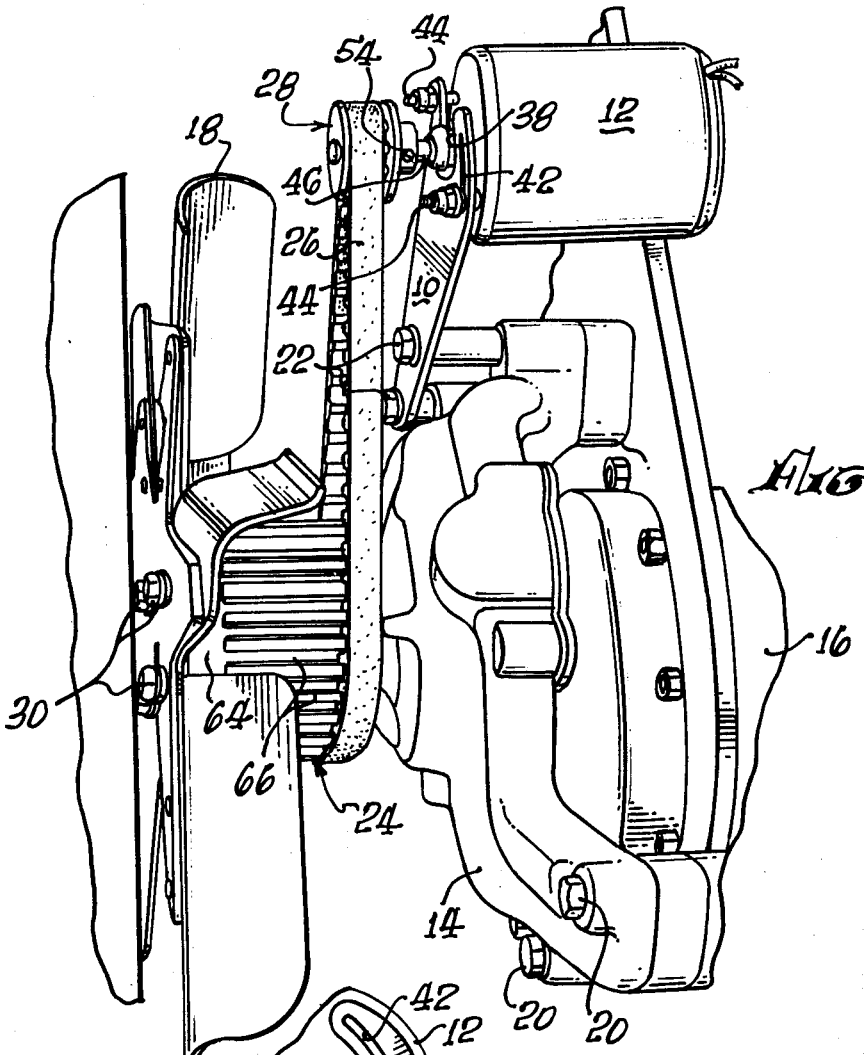
FIG. 1 is a perspective view showing the invention electric drive installed on a conventional automobile engine.
Figure 3:
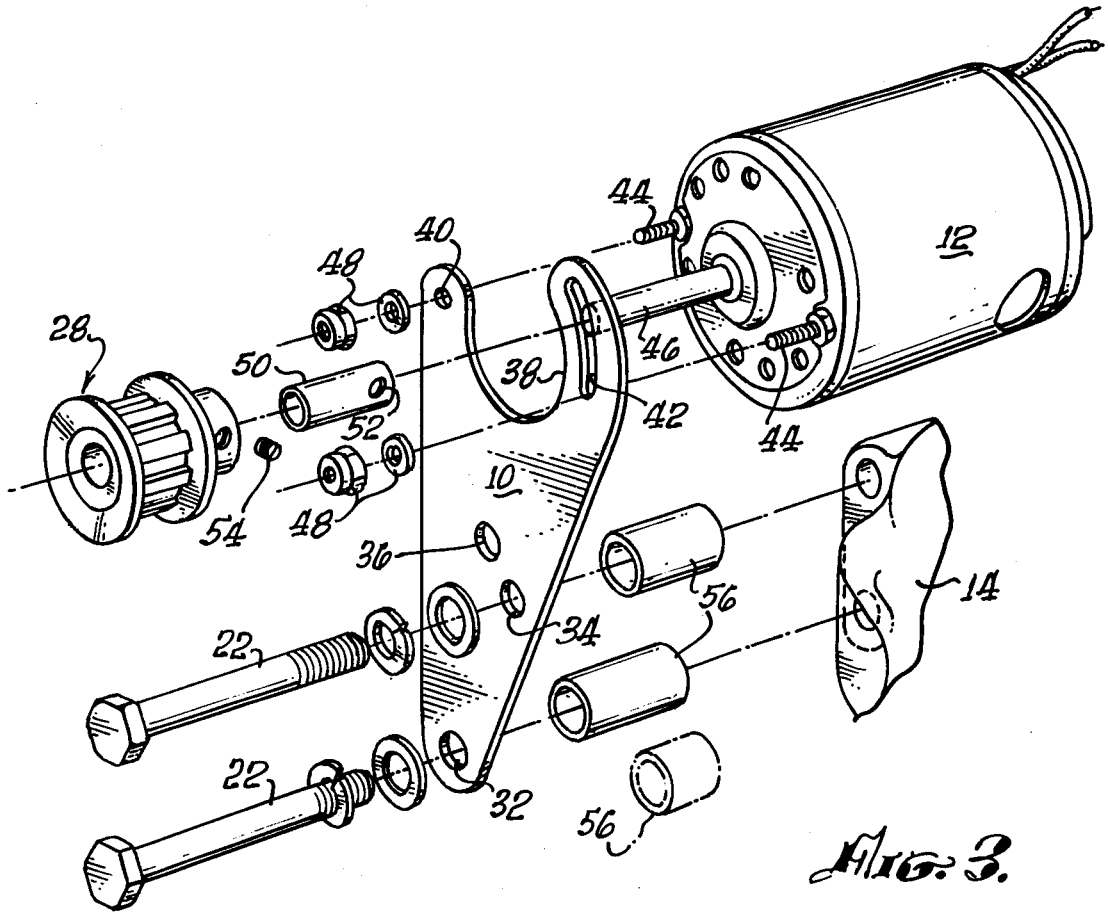
FIG. 3 is an exploded perspective view of the drive kit of the invention.

Referring now to FIGS. 1 and 3, the invention comprises a bracket 10 on which is mounted an electric motor 12. A conventional water pump 14 is mounted on a conventional engine 16 which also includes a conventional radiator or cooling fan 18. Pump 14 is held on engine 16 by at least four bolts 20, two of which have been replaced by longer but otherwise similar bolts or studs 22. These elongated bolts 22 are included in the invention kit for converting from a conventional water pump drive to the electric motor drive.

The drive includes a pulley 24 which is mounted to fan 18 by a plurality of bolts 30. Pulley 24 is put in place of the conventional fan pulley which was removed and is not shown. A belt 26 connects the driven pulley 24 to a drive pinion 28 mounted on the shaft of motor 12 in a manner described below.

Bracket 10 is of generally triangular configuration, and is formed with a hole 32 adjacent its apex. A pair of mounting holes 34 and 36 are formed in the body of the bracket, between the hole 32 and its enlarged other end. At said other end, the bracket includes an enlarged cutout 38, and which bifurcates the enlarged end. The cutout 38 extends in from what would otherwise be the short base of the triangular bracket 10. To one side of the cutout 38 bracket 10 is formed with a hole 40 of a predetermined diameter, and at its other side is formed with an arcuate slot 42 which is of the same width as the diameter of the hole 40. Bracket 10 is thus a very inexpensive, simple to manufacture, part comprising simply a flat, stamped piece of metal. Shapes other than triangular could also be used.

Motor 12 comprises a pair of main assembly screws 44 which extend through its length and which extend out to the end thereof to which the main drive shaft of the motor 46 extends. The screw ends 44 extend parallel to the motor shaft 46 and in equally spaced relationship to either side thereof, the three parts 44, and 46 forming a generally diametrical line across the motor 12. These two screw ends 44 cooperate with the hole 40 and the slot 42 to provide the swinging mount of the motor 12 on the bracket 10, as is evident from FIGS. 3 and 2. One screw is the pivot, and the other screw slides or moves in the arcuate slot. Suitable securing means, such as the nuts and washers 48 shown hold the motor 12 on the portions 40 and 42 of the bracket 10 via these screws 44. In the successfully constructed embodiment of the invention, motor 12 was a standard air conditioning blower motor. Other suitable motors could also be used.

The pinion 28 is a standard device for cooperation with the particular positive drive cog belt 26. However, it has an inside diameter substantially larger than the diameter of the shaft 46 of the motor 12. In order to accommodate these two different sized parts, the invention includes a sleeve member 50 formed with an opening 52 which receives the standard set screw 54 included in the pinion 28.

The use of the sleeve 50 allows the invention to use the relatively inexpensive, highly reliable and rugged standard air conditioner blower motor 12 together with the conventional cog pinion 28. Absent this adapting means between these otherwise two unrelated components, one or the other of them would have to be specially manufactured, thus greatly increasing the costs of the invention as well as reducing its versatility and ease of repair and replacement.

Means are provided to mount the bracket 10 perpendicular to the center line of the water pump shaft and perpendicular to the motor shaft 46 with the electric motor shaft and water pump shaft thereby being disposed parallel to each other. The bosses on the water pump housing 14 have different heights along this parallel axis direction, and to this end the invention kit includes a plurality of tubular spacers 56, each having a different length of accommodate the different heights of the openings in the bosses of the water pump 14.

Figure 2:
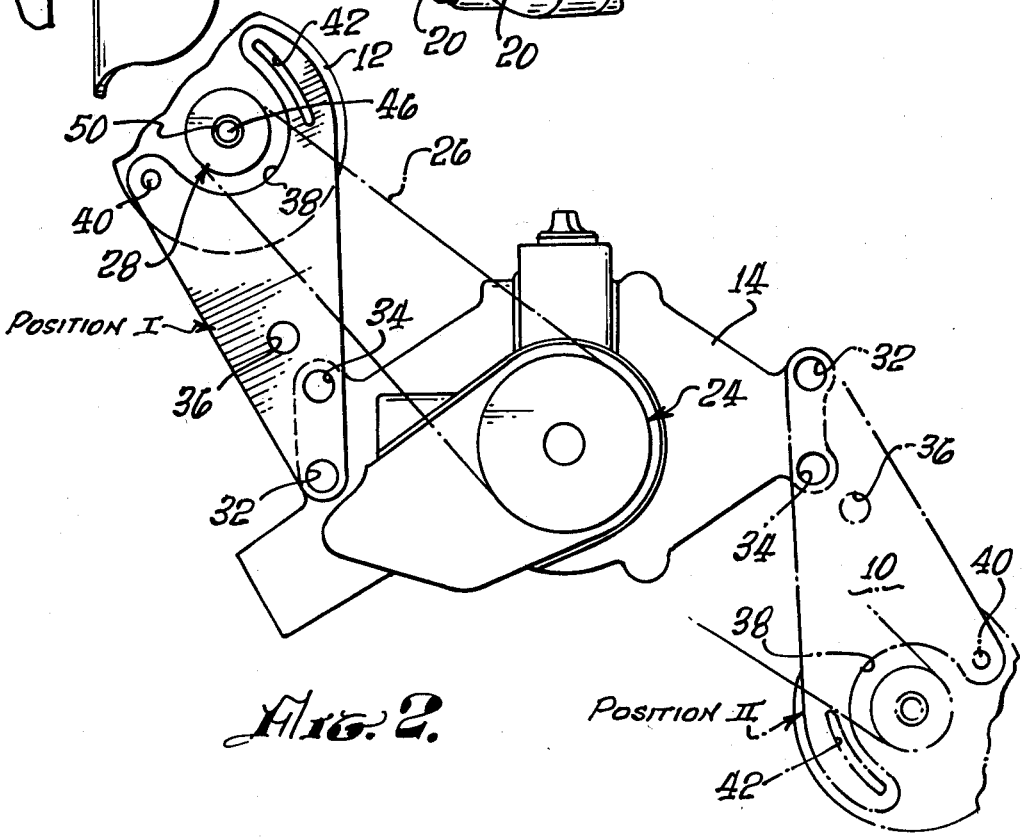
FIG. 2 is a front elevational view showing the bracket and water pump and showing the second alternative position in a dot/dash or phantom view.

Referring to FIG. 2, there is shown another aspect of the versatility of the invention. The solid line showing marked position 1 of the bracket 10 is that shown in the other figures. The dotted line showing marked position 2 on the right hand side shows an alternative position on the same water pump 14. In both cases, the pair of holes 32 and 34 in the bracket 10 are used for mounting. That is, for this particular engine shown in the drawings, the holes 32 and 34 will mount the bracket in either position. The third hole 36, in cooperation with the hole 32, is used in other engines, more specifically, the "large block" Chevrolet engine. These two engines, the large block and the small block Chevrolets, are currently exceedingly popular racing engines. Of course, it would be a very simple pedestrian matter to relocate the holes 32, 34, and 36 to other positions so as to permit the invention to be used with other water pumps on other engines.

Figure 4:
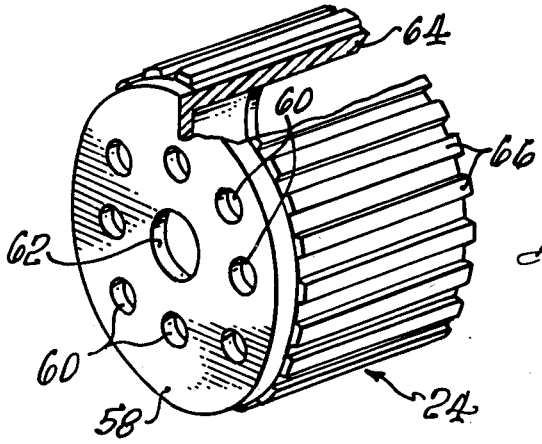
FIG. 4 is a partial sectional view of the invention drive pulley.

Referring to FIG. 4, the drive pulley 24 is shown in detail. In the prior art, metal pulleys, aluminum usually, were used. The invention contemplates the use of a fiberglass reinforced or filled plastic molded part as this pulley. Pulley 24 is of generally cuplike configuration, and comprises an end face 58 formed with a plurality of mounting holes 60 surrounding a central enlarged through hole 62. The opening 62 permits passage of the shaft from the water pump 14 to the fan 18, while clearing the pulley 24 and not contacting it. Pulley 24 is mounted by the bolts 30 to the fan 18 via any combination of the various holes 60. Here again, the versatility of the invention permitting its mounting to many different fans, is achieved. This is important because different racers use different fans. A fan is a power consuming element, and thus each racer will often fit his favorite fan to this car, the various fans having different numbers and positions of holes. The end face 58 of the pulley 24 is so fabricated that virtually any such fan can be accommodated. In fact, because of the use of the plastic material, a racer can drill one or two new openings for cooperation with some of the existing openings 60 to accommodate an unusual fan.

The skirt or cylindrical face 64 of the pulley 24 is formed with the cog teeth 66 for cooperation with the belt 26, and, of course, the teeth are similar to those on pinion 28. The skirt 64 and the length of the teeth 66 are considerably more than the width of the belt 26 because the length is needed to extend the pulley out beyond the fan so that the belt will be trained between the pinion 28 and the pulley 24 while clearing the fan blades.

The invention is wired into the automobile in an extremely simple manner. A series circuit connecting the motor 12, a manual switch, not shown, added at the dash board or other convenient location, and the car battery or convenient power source is all that is needed. By operating the switch, the motor 12 is connected to the electrical power of the automobile to drive the water pump, and is turned on or off independently of whether or not the engine is running.

While the invention has been described in detail above, it is to be understood that this detailed description is by way of example only, and the protection granted is to be limited only within the spirit of the invention and the scope of the following claims.

I claim:

1. An apparatus to retro-fit an independent electric motor to drive the shaft of a water pump attached to an automobile engine in place of the conventional water pump drive from the engine whereby more power from said engine is delivered to the road drive wheels, comprising an electric motor having an output shaft and two parallel mounting screws extending out of one end of the motor with the screws on opposite sides diametrically thereof;

an output drive pinion means, having a circular inside opening adapted to engage said output shaft and with a securing set screw to secure the pinion to the output shaft of the motor;

a bracket means for adjustably holding said two mounting screws of the electric motor, said bracket means consisting essentially of a flat plate with a plurality of mounting holes formed on one end to permit attachment of the bracket to the water pump and engine in one of at least two different positions with respect thereto and with a clearance cut-out at another end of the flat plate to clear the electric motor shaft, an opening formed in said flat plate to one side of the cut-out to receive a first one of said electric motor screws, an arcuate slot in the flat plate to the other side of the cut-out, and said arcuate slot having a width to snugly receive the other of the electric motor screws and being so disposed as to permit a swinging motion of the electric motor on the flat plate using the first one of the electric motor screws when said first screw is mounted on said opening in said flat plate as a pivot;

attachment bolts replacing previous water pump attachment bolts to attach the bracket means to the water pump and to the engine, said attachment bolts having the same thread and diameter as said original bolts mounting the water pump to the engine and being a predetermined amount longer than said original bolts;

a spacer surrounding the portion of the length of each of said attachment bolts between said bracket means and said water pump, said spacers holding the bracket means in a predetermined spaced relation to the water pump to position the shaft of the electric motor mounted on the bracket means and the shaft of the water pump in alignment with each other; and means to transmit the drive from the electric motor to the shaft of the water pump, whereby the distance between the shaft of the electric motor and the water pump may be adjusted to tension the drive transmitting means.

2. The apparatus of claim 1, further comprising a radiator cooling fan attached to the shaft of said water pump and wherein said driven pulley being of generally cup-like configuration and having a generally circular end face formed with a center clearance opening to permit attachment of the water pump shaft to the radiator cooling fan, said driven pulley end face being formed with a plurality of mounting holes, whereby said pulley may be attached to any one of various different fans using various ones of said holes.

3. The apparatus of claim 2, wherein said driven pulley is made of molded reinforced plastic.

4. The apparatus of claim 1, wherein said driven pulley replaces the engine driven water pump pulley of said engine, said driven pulley being of generally cup-like configuration and having a skirt portion in an annular disposition with respect to the shaft of said water pump, said skirt portion being formed with cog teeth, said positive drive pinion being formed with similar cog teeth, and said drive transmitting means comprising a cog belt interconnecting means comprising a cog belt interconnecting said pinion and said pulley.

5. The apparatus of claim 1, wherein the diameter of the inside circular opening of the output drive pinion is larger than the diameter of the output shaft, and further comprising a sleeve sized to fit snugly into said pinion inside opening and over said electric motor shaft, with said sleeve being formed with a radial clearance opening sized to permit the securing set screw of said pinion to clear said sleeve and to bear on said electric motor shaft.

* * * * *